US010151125B2

(12) United States Patent
Ring

(10) Patent No.: US 10,151,125 B2
(45) Date of Patent: Dec. 11, 2018

(54) HATCH COVER LOCK

(71) Applicant: New York Air Brake, LLC, Watertown, NY (US)

(72) Inventor: Michael E Ring, Saint John, IN (US)

(73) Assignee: New York Air Brake, LLC, Watertown ( * ) Notice: Subject to any disclaimer, the term of this patent is extended or adjusted under 35 U.S.C. 154(b) by 376 days.

(21) Appl. No.: 14/998,008

(22) Filed: Sep. 11, 2014

(65) Prior Publication Data

US 2016/0177604 A1 Jun. 23, 2016

(51) Int. Cl.

| | |
|---|---|
| ***E05B 83/36*** | (2014.01) |
| ***E05C 3/30*** | (2006.01) |
| ***E05B 15/02*** | (2006.01) |
| *E05B 13/00* | (2006.01) |
| *E05B 15/00* | (2006.01) |

(52) U.S. Cl.

CPC ..... *E05B 83/363* (2013.01); *E05B 15/022* (2013.01); *E05C 3/30* (2013.01); *E05B 13/002* (2013.01); *E05B 15/0086* (2013.01); *E05B 15/0093* (2013.01); *Y10T 292/089* (2015.04); *Y10T 292/0917* (2015.04); *Y10T 292/202* (2015.04); *Y10T 403/7016* (2015.01); *Y10T 403/7045* (2015.01)

(58) Field of Classification Search

CPC ..... Y10T 292/089; Y10T 292/0917; Y10T 292/202; Y10T 403/7016; Y10T 403/7045

USPC ..... 297/440.1

See application file for complete search history.

(56) References Cited

U.S. PATENT DOCUMENTS

| | | | | | |
|---|---|---|---|---|---|
| 1,719,282 | A | * | 7/1929 | Wilson | E05B 55/00 292/2 |
| 3,116,080 | A | * | 12/1963 | Williams | E05C 1/163 292/1 |
| 3,848,912 | A | * | 11/1974 | Jensen | E05O 5/00 292/113 |
| 4,021,067 | A | * | 5/1977 | Nadherny | E05C 5/00 105/377.11 |
| 4,307,670 | A | | 12/1981 | Nadherny | |
| 4,365,832 | A | * | 12/1982 | Treppler | B63B 19/24 105/377.11 |
| 5,267,457 | A | * | 12/1993 | Sorensen | E05B 63/0017 292/150 |
| 5,314,218 | A | | 5/1994 | Nadherny | |
| 5,765,922 | A | * | 6/1998 | Hsia | A47C 3/029 297/440.1 |

(Continued)

*Primary Examiner* — Carlos Lugo

(74) *Attorney, Agent, or Firm* — Bond Schoeneck and King PLLC; David Nocilly

(57) ABSTRACT

A hatch cover lock comprises a front member including a pair of flanges, a rear member positioned between the pair of flanges; a gap defined between front member and the rear member; a clamp defining a J-shaped cross-section in a plane normal to a length thereof, the clamp having one leg thereof disposed in the gap and having another leg thereof disposed parallel to an outer surface of the rear member and at a distance therefrom, a handle, a first pivotal connection between the handle and the front member, a gravity lock, a second pivotal connection between the gravity lock and the handle, and a weld-free connection between the main portion of the rear member and the main portion of the front member.

2 Claims, 9 Drawing Sheets

(56) References Cited

U.S. PATENT DOCUMENTS

| | | | | |
|---|---|---|---|---|
| 5,785,362 | A * | 7/1998 | Nadherny | B61D 7/24 105/377.11 |
| 6,039,362 | A | 3/2000 | Nadherny | |
| 6,341,806 | B1 * | 1/2002 | Chung | E05C 19/06 292/120 |
| 6,932,192 | B2 * | 8/2005 | Blythe | B63B 27/146 182/82 |
| 7,176,376 | B2 * | 2/2007 | Stachowiak, Jr. | G01R 11/04 174/135 |
| 7,219,962 | B2 * | 5/2007 | Stone | A47C 4/021 297/440.1 |
| 7,748,758 | B2 * | 7/2010 | Fang | E05B 55/005 292/347 |
| 8,182,005 | B2 * | 5/2012 | Liu | E05B 55/005 292/347 |
| 8,485,567 | B1 * | 7/2013 | Meuchel | E05C 1/04 292/137 |
| 8,590,976 | B2 * | 11/2013 | Davis | A47B 47/0075 297/440.1 |
| 2003/0205904 | A1 * | 11/2003 | Paskonis | E05B 85/045 292/340 |
| 2013/0074415 | A1 * | 3/2013 | Rix | E05B 35/008 49/465 |
| 2014/0015259 | A1 * | 1/2014 | Harrigan | E05B 65/0014 292/156 |

* cited by examiner

HATCH COVER LOCK

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

1. Technical Field

The subject matter relates to hatch cover lock for railway vehicles, and, more particularly, the subject matter relates to hatch cover lock employed for securing a hatch cover to a railway hopper car, industrial tanks.

2. Description of Related Art

Hatch cover locks are widely used for securing a removable hatch cover to railway hopper car. The general structure and operation of the hatch cover lock may be of a type as taught in U.S. Pat. No. 5,314,218 issued on May 24, 1994 to Nadherny, and whose teachings are incorporated into this document by reference thereto. Conventional hatch cover locks employ an inner member that may be welded to the turned side flanges of the outer member. Such hatch cover locks have been characterized by a greater than desired costs and impact on environment due to weld splatter.

Therefore, there is a need for a low cost hatch cover lock that addresses concerns with the conventional types.

DETAILED DESCRIPTION

Figure 1:
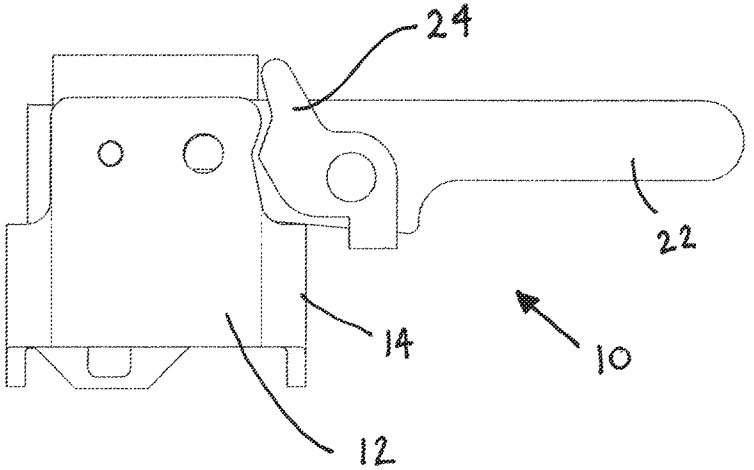
FIG. 1 (PRIOR ART)
FIG. 1 illustrates a front view of a prior art hatch cover lock.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
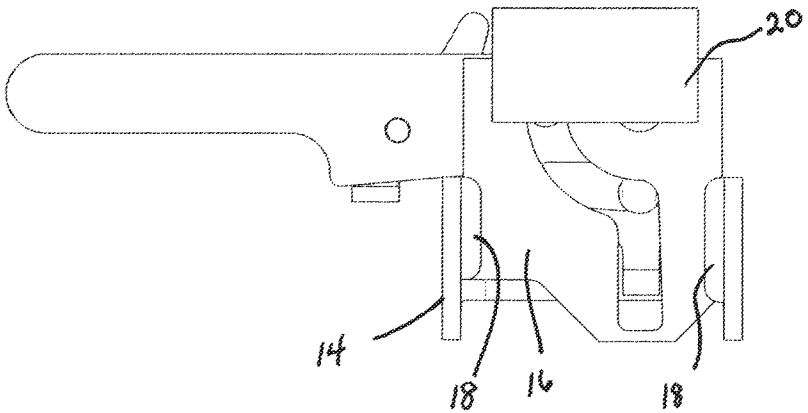
FIG. 2 (PRIOR ART)
FIG. 2 illustrates a rear view of the prior art hatch cover lock of FIG. 1.
Figure 3:
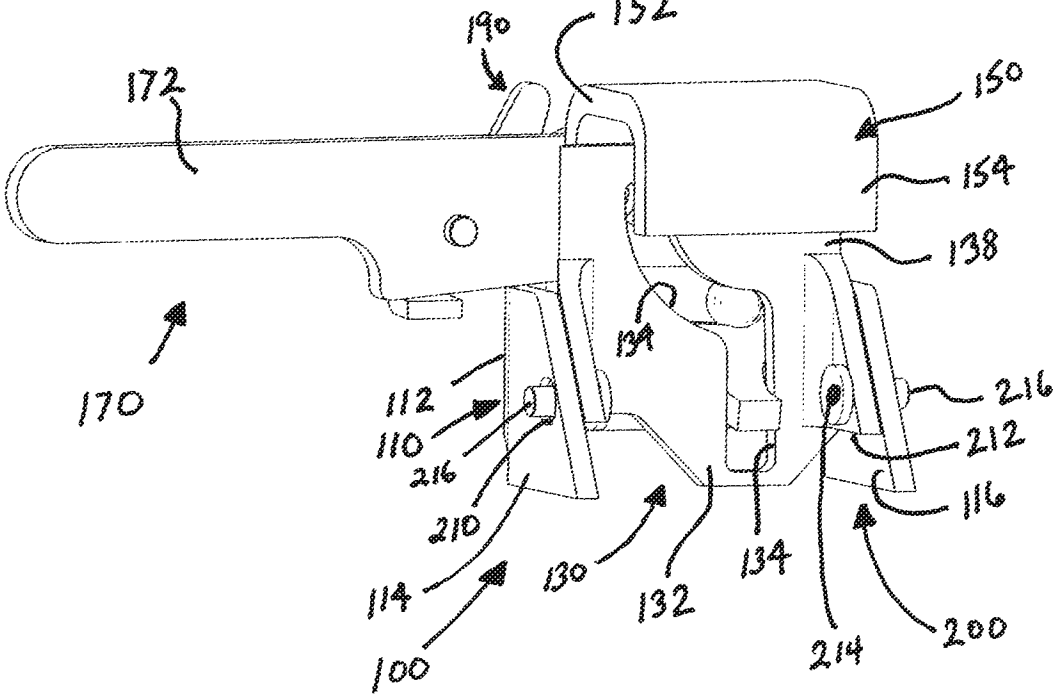
FIG. 3 illustrates a rear perspective view of one example of a hatch cover lock.
Figure 5:
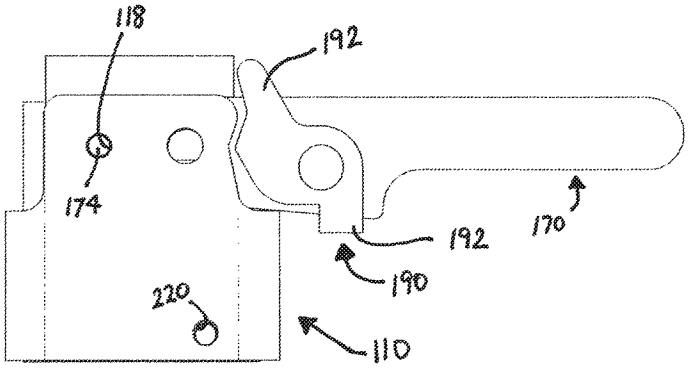
FIG. 5 illustrates a front view of the hatch cover lock of FIG. 4.
Figure 4:
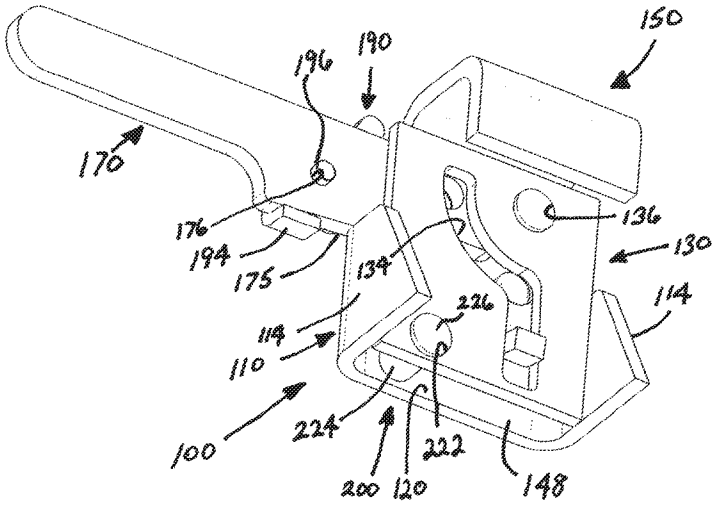
FIG. 4 illustrates a rear perspective view of another example of a hatch cover lock.

For the sake of reader's convenience, the prior art hatch cover lock 10 of FIGS. 1-2 comprises a front member 12 with a pair of upstanding flanges 14, a rear member 16, a clamp 20, a handle 22, a first pivotal connection between the handle and the front member, a gravity lock 24, a second pivotal connection between the gravity lock 24 and the handle 22, and a welded connection 18 between the side edges of the rear member 16 and the inner surfaces of the flanges 14 of the front member 12.

The subject matter provides a hatch cover lock 100 for securing a hatch cover to railway hopper car. The hatch cover lock 100 comprises a front member 110, a rear member 130, a clamp 150, a handle 170, a first pivotal connection between the handle and the front member, a gravity lock 190, a second pivotal connection between the gravity lock 190 and the handle 170, and a weld-free connection 200 between the rear member 130 and the front member 110.

The hatch cover lock 100 can be employed on the railway hopper cars, industrial tanks and the like applications.

The front member 110 includes a main portion 112, a pair of flanges 114 upstanding on the main portion 112 adjacent opposite edges thereof and an aperture 118 formed through a thickness of the main portion.

The rear member 130 includes a plate-shaped main portion 132 and a curved slot 134 formed through a thickness of the main portion 132 of the rear member 130, an aperture 136 formed through the thickness of the main portion 132 of the rear member 130, the plate-shaped main portion 132 having a width thereof sized to be positioned between inner surfaces 116 of the pair of flanges 114.

A gap 148 is defined between an inner surface 120 of the main portion 112 of the front member 110 and an inner surface 136 of the main portion 132 of the rear member 130.

The clamp 150 defines a J-shaped cross-section in a plane normal to a length thereof. The clamp 150 has one leg 152 thereof disposed in the gap 148 and has another leg 154 thereof disposed parallel to an outer surface 138 of the main portion 132 of the rear member 130 and at a distance therefrom.

The handle 170 is also positioned within the gap 148 and has a portion 172 extending away from the front and rear members, 110 and 130 respectively.

The first pivotal connection between the handle 170 and the front member 110 includes a pin or axle 174 received within the apertures 118 and 136.

The gravity lock 190 includes the main portion 192 and a tab 194 extending normal to a surface of the main portion 192 and abutting, in operation, the edge 175 of the portion 172 of the handle 170.

The second pivotal connection between the gravity lock 190 and the handle 170 includes an aperture 176 formed through a thickness of the portion 172 and a pin 196 received within the aperture 176.

Now in reference to FIGS. 3 and 10-16, the weld-free connection 200 between the rear member 130 and the front member 110 can include an aperture 210 formed through a thickness of the each of the pair of flanges 114 of the front member 110, a pair of flanges 212 upstanding on the outer surface 138 of the main portion 132 of the rear member 130, each of the pair of flanges 212 of the main portion 132 of the rear member 130 disposed parallel to a respective one of the pair of flanges 114 of the front member 110, an aperture 214 formed through a thickness of each one of the pair of flanges 212 upstanding on the outer surface 138 of the main portion 132 of the rear member 130 and a pair of fasteners 216, each of the pair of fasteners 216 at least passed through aligned apertures 210, 214 in aligned flanges 114, 212 of the front and rear members, 110 and 130 respectively. Such fastener 216 may be a rivet, a threaded fastener, a pin and the like fasteners that eliminate movement of the rear member 130 relative to the front member 110.

Now in reference to FIGS. 4-5 and 17-23, the weld-free connection 200 can include a first aperture formed through a thickness of the main portion 112 of the front member 110, a second aperture 222 formed through a thickness of the main portion 132 of the rear member 130, a spacer 224 positioned in the gap 148 and having a hollow interior thereof aligned with the first and second apertures, 220 and 222 respectively, and a fastener 226 at least passed through the hollow interior and the first and second apertures, 220 and 222 respectively.

Now in reference to FIGS. 6-7 and 23-30, the weld-free connection 200 can include a first aperture formed through a thickness of the main portion 112 of the front member 110, a second aperture 222 formed through a thickness of the main portion 132 of the rear member 130, a spacer 224 positioned in the gap 148 and having a hollow interior thereof aligned with the first and second apertures, 220 and 222 respectively, and a fastener 226 at least passed through the hollow interior and the first and second apertures, 220 and 222 respectively, a notch 230 formed in a bottom edge of each of the pair of flanges 114, and a tab 232 extending from each side edge 140 of the main portion 132 of the rear member 130 in a planar relationship therewith, the tab 232 being sized and shaped to be received within a respective notch 230, wherein the each side edge 140 directly abuts an inner surface 116 of a respective flange 114. The notches 230 and tabs 232 are so shaped and sized that any movement of the rear member 130 relative to the front member 110 is eliminated.

In a further reference to FIGS. 6-7 and 23-30, the weld-free connection 200 can include a notch 230 formed in a bottom edge of each of the pair of flanges 114, and a tab 232 extending from each side edge 140 of the main portion 132 of the rear member 130 in a planar relationship therewith, the tab 232 being sized and shaped to be received within a respective notch 230, wherein the each side edge 140 directly abuts an inner surface 116 of a respective flange 114. The notches 230 and tabs 232 are so shaped and sized that any movement of the rear member 130 relative to the front member 110 is eliminated.

Now in reference to FIGS. 8-9 and 31-37, the weld-free connection 200 can include a notch 236 formed in a bottom edge of each of the pair of flanges 114, and a tab 240 having a first tab portion 242 extending from the outer surface 138 of the main portion 132 of the rear member 130 normal thereto and a second tab portion 244 extending outwardly from an edge of a respective first portion 242, the second tab portion 244 being sized and shaped to be received within a respective notch 236, wherein each side edge 140 directly abuts an inner surface 116 of a respective flange 114.

Figure 7:
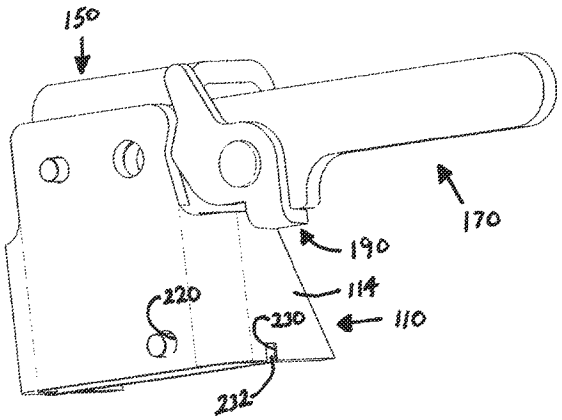
FIG. 7 illustrates a front perspective view of the hatch cover lock of FIG. 6.
Figure 6:
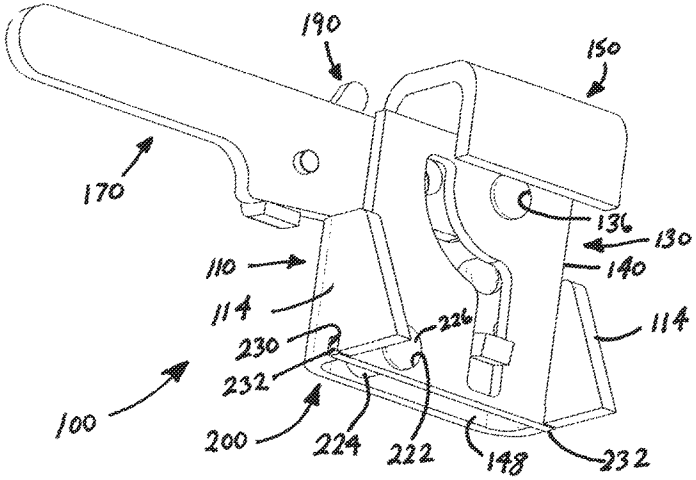
FIG. 6 illustrates a rear perspective view of yet another example of a hatch cover lock.
Figure 9:
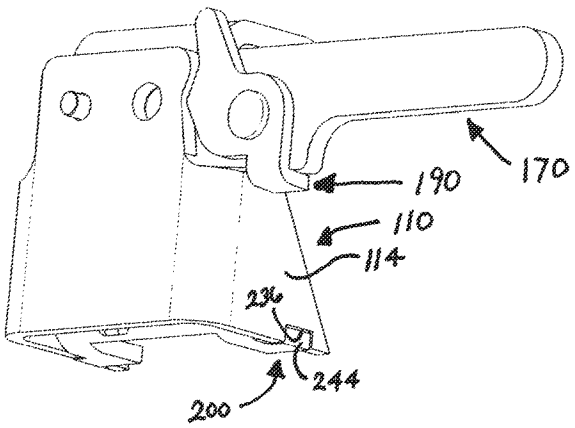
FIG. 9 illustrates a front perspective view of the hatch cover lock of FIG. 8.
Figure 8:
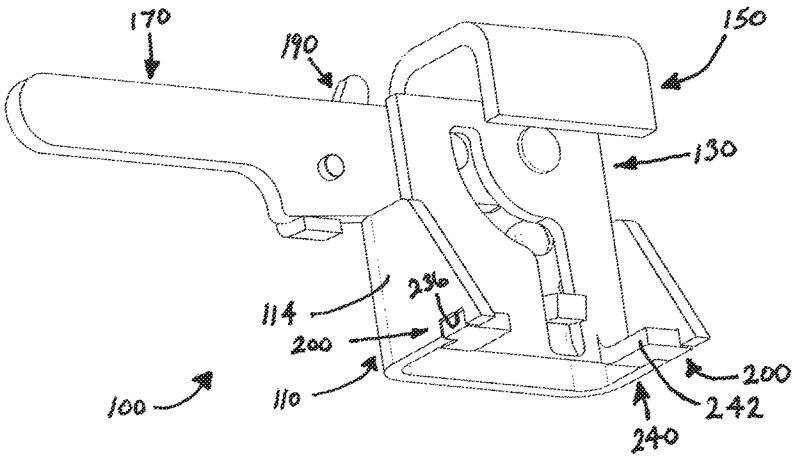
FIG. 8 illustrates a rear perspective view of a further example of a hatch cover lock.
Figure 10B:
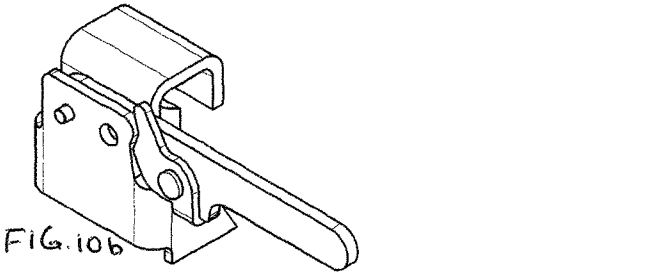
FIGS. 10*a-d* illustrate an ornamental design of one example of a hatch cover lock for securing a hatch cover.
Figure 12:
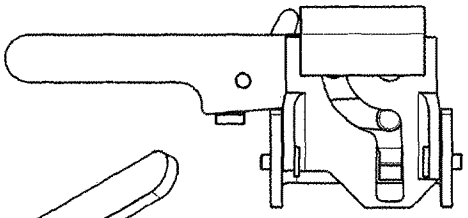
FIG. 12 illustrates a rear view of the hatch cover lock in FIGS. 10*a-d;*
Figure 16:
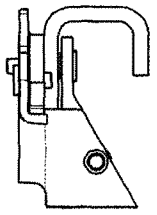
FIG. 16 illustrates a right view of the hatch cover lock in FIGS. 10*a-d;*
Figure 10C:
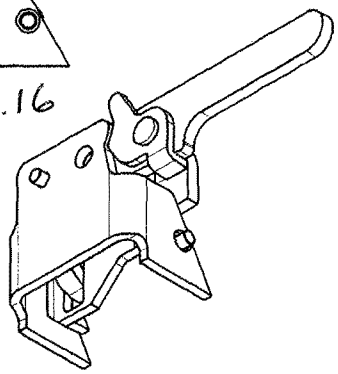
Figure 10A:
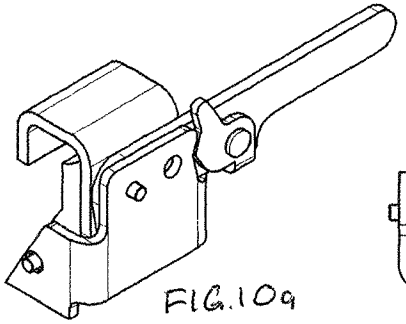
Figure 13:
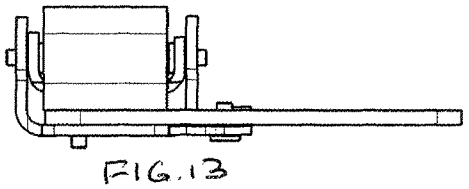
FIG. 13 illustrates a top view of the hatch cover lock in FIGS. 10*a-d;*
Figure 11:
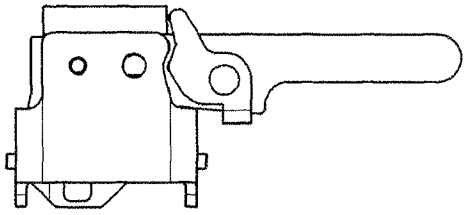
FIG. 11 illustrates a front view of the hatch cover lock in FIGS. 10*a-d;*
Figure 14:
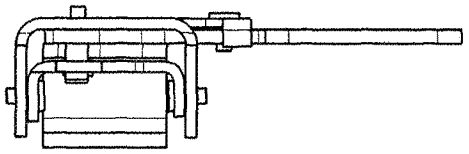
FIG. 14 illustrates a bottom view of the hatch cover lock in FIGS. 10*a-d;*
Figure 15:
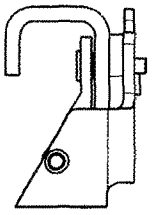
FIG. 15 illustrates a left view of the hatch cover lock in FIGS. 10*a-d;*
Figure 10D:
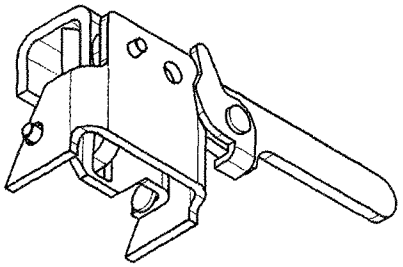
Figures 17A, 17B, 17C, 17D, 18, 19, 20, 21, 22, 23:
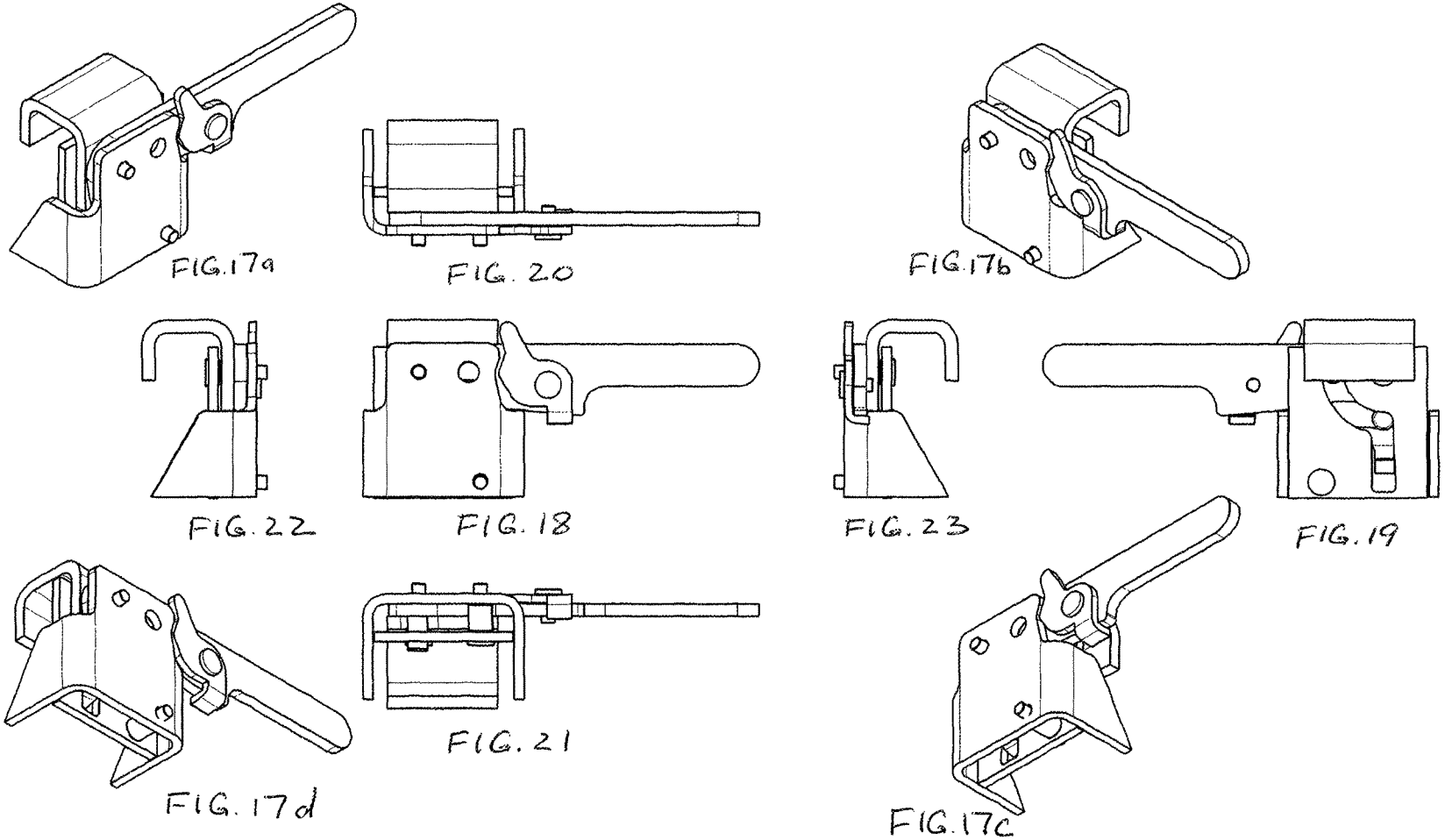
FIGS. 17*a-d* illustrate an ornamental design of another example of a hatch cover lock for securing a hatch cover.
FIG. 18 illustrates a front view of the hatch cover lock in FIGS. 17*a-d;*
FIG. 19 illustrates a rear view of the hatch cover lock in FIGS. 17*a-d;*
FIG. 20 illustrates a top view of the hatch cover lock in FIGS. 17*a-d;*
FIG. 21 illustrates a bottom view of the hatch cover lock in FIGS. 17*a-d;*
FIG. 22 illustrates a left view of the hatch cover lock in FIGS. 17*a-d;*
FIG. 23 illustrates a right view of the hatch cover lock in FIGS. 17*a-d;*
Figure 24B:
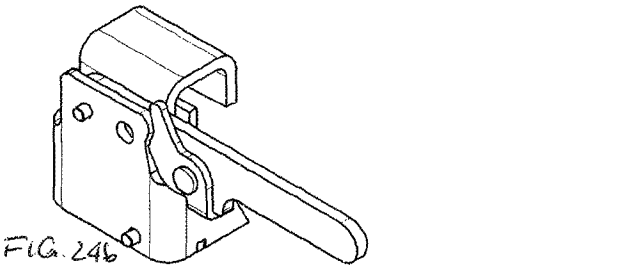
FIGS. 24*a-d* illustrate an ornamental design of yet another example of a hatch cover lock for securing a hatch cover.
Figure 26:
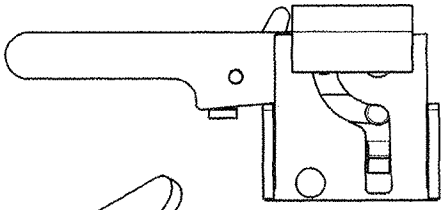
FIG. 26 illustrates a rear view of the hatch cover lock in FIGS. 24*a-d;*
Figure 30:
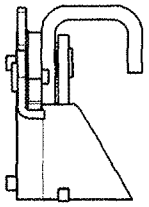
FIG. 30 illustrates a right view of the hatch cover lock in FIGS. 24*a-d;*
Figure 24C:
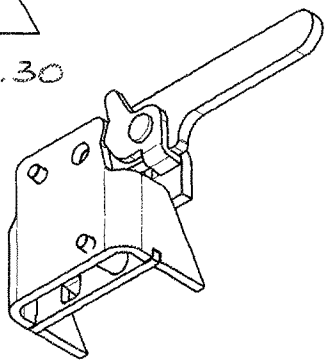
Figure 24A:
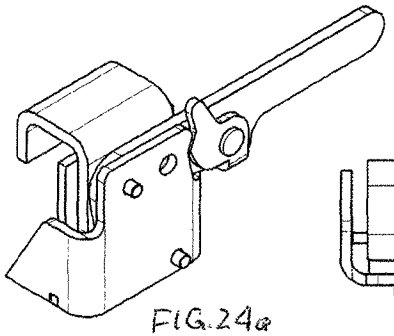
Figure 27:
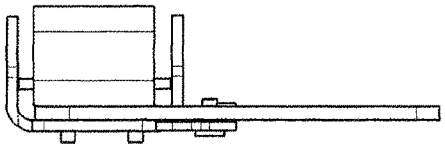
FIG. 27 illustrates a top view of the hatch cover lock in FIGS. 24*a-d;*
Figure 25:
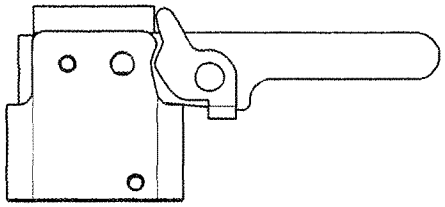
FIG. 25 illustrates a front view of the hatch cover lock in FIGS. 24*a-d;*
Figure 28:
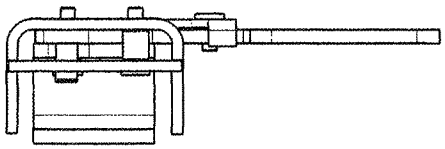
FIG. 28 illustrates a bottom view of the hatch cover lock in FIGS. 24*a-d;*
Figure 29:
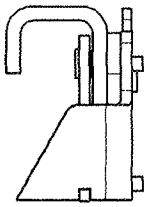
FIG. 29 illustrates a left view of the hatch cover lock in FIGS. 24*a-d;*
Figure 24D:
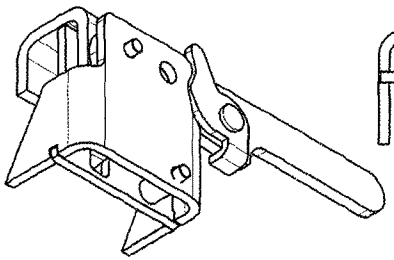
Figure 31B:
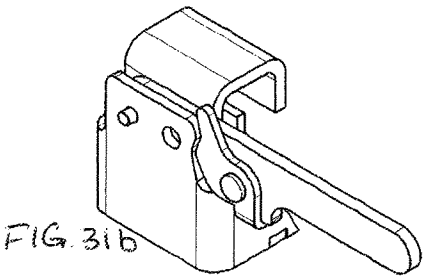
FIGS. 31*a-d* illustrate an ornamental design of yet another example of a hatch cover lock for securing a hatch cover.
Figure 33:
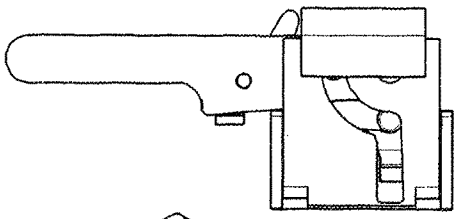
FIG. 33 illustrates a rear view of the hatch cover lock in FIGS. 31*a-d;*
Figure 31C:
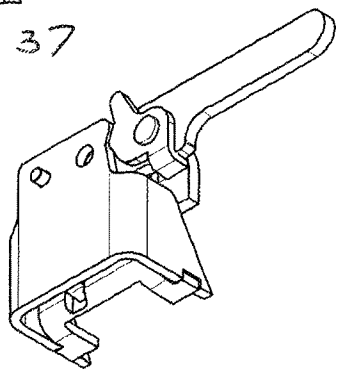
Figure 37:
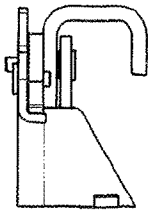
FIG. 37 illustrates a right view of the hatch cover lock in FIGS. 31*a-d.*
Figure 34:
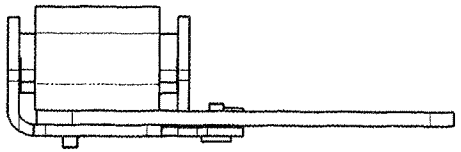
FIG. 34 illustrates a top view of the hatch cover lock in FIGS. 31*a-d;*
Figure 32:
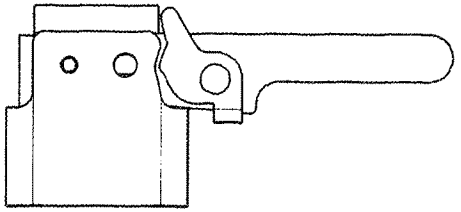
FIG. 32 illustrates a front view of the hatch cover lock in FIGS. 31*a-d;*
Figure 35:
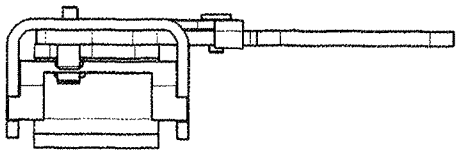
FIG. 35 illustrates a bottom view of the hatch cover lock in FIGS. 31*a-d;*
Figure 31A:
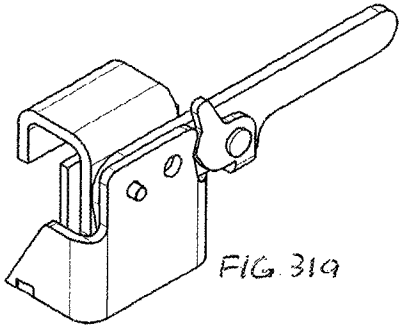
Figure 36:
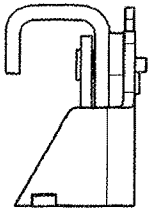
FIG. 36 illustrates a left view of the hatch cover lock in FIGS. 31*a-d*.
Figure 31D:
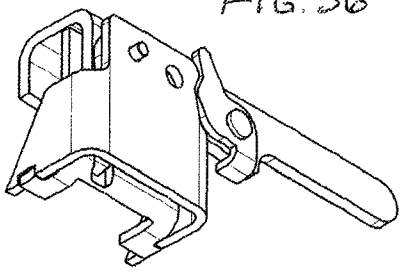

The subject matter of FIGS. 8-9 and 31-37 may also include the spacer 124 positioned in the gap 148 and having a hollow interior thereof aligned with the first and second apertures, 220 and 222 respectively, and a fastener 226 at least passed through the hollow interior and the first and second apertures, 220 and 222 respectively, as described in reference to FIGS. 6-7.

The weld-free connection 200 includes a first aperture formed through a thickness of the main portion of the front member 110, a second aperture formed through a thickness of the main portion of the rear member 130, a spacer positioned in the gap and having a hollow interior thereof aligned with the first and second apertures, a fastener 226 at least passed through the hollow interior and the first and second apertures, a notch formed in a bottom edge of each of the pair of flanges, and a tab extending from each side edge of the main portion of the rear member 130 in a planar relationship therewith, the tab being sized and shaped to be received within a respective notch, wherein the each side edge directly abuts an inner surface of a respective flange.

The weld-free connection 200 may also include a first aperture formed through a thickness of each of the pair of flanges, a bore formed within a thickness of the main portion of the rear member 130 in an open communication with a side edge thereof and in an alignment with a respective first aperture, and a fastener passed through first aperture into the bore so as to eliminate movement of the rear member 130 relative to the front member 110, wherein the each side edge directly abuts an inner surface of a respective flange.

What is claimed is:

1. A hatch cover lock, comprising:

(a) a front member comprising a pair of flanges;

(b) a rear member positioned between inner surfaces of said pair of flanges parallel to said front member;

(c) a gap defined between said front member and said rear member;

(d) a clamp defining a J-shaped cross-section in a plane normal to a length thereof, said clamp having one leg thereof disposed in said gap;

(e) a handle extending outwardly from said front and rear members;

(f) a first pivotal connection between said handle and said front member;

(g) a gravity lock;

(h) a second pivotal connection between said gravity lock and said handle; and (i) a weld-free connection between said rear member and said front member, wherein the weld-free connection is a pair of tabs positioned between the pair of flanges, each tab having a first tab portion extending along the respective flange from an outer surface of the rear member normal thereto, and a second tab portion extending outwardly from an edge of the first tab portion being sized and shaped to be fastened to a notch on a respective flange.

2. The hatch cover lock of claim 1, wherein said weld-free connection between said rear member and said front member eliminates a movement of said rear member relative to said front member.

* * * * *